US006134717A

United States Patent [19]

Grilliot et al.

[11] Patent Number: 6,134,717

[45] Date of Patent: Oct. 24, 2000

[54] PROTECTIVE GARMENT WITH LEG PORTIONS AND WITH CUFFS TO PREVENT LIQUIDS FROM ENTERING BOOTS

[75] Inventors: William L. Grilliot; Mary I. Grilliot, both of Dayton, Ohio

[73] Assignee: Morning Pride Manufacturing, L.L.C., Dayton, Ohio

[21] Appl. No.: 09/197,046

[22] Filed: Nov. 20, 1998

[51] Int. Cl.[7] ..... A41D 1/06

[52] U.S. Cl. ..... 2/227; 2/69; 2/81

[58] Field of Search ..... 2/227, 69, 79, 2/80, 81, 82, 239, 231, 232, 242

[56] References Cited

U.S. PATENT DOCUMENTS

| | | | |
|---|---|---|---|
| Re. 34,662 | 7/1994 | Keller . | |
| 1,670,213 | 5/1928 | Robichon . | |
| 2,274,270 | 2/1942 | Kalb | 2/227 |
| 3,268,914 | 8/1966 | Barber | 2/227 |
| 4,091,466 | 5/1978 | Kearn | 2/23 |
| 4,373,215 | 2/1983 | Guigley et al. . | |
| 4,458,363 | 7/1984 | Harvey | 2/22 |
| 4,509,213 | 4/1985 | Harvey | 2/22 |
| 4,554,684 | 11/1985 | Cadoret | 2/227 |
| 4,773,100 | 9/1988 | Kuo | 2/46 |
| 4,791,685 | 12/1988 | Maibauer | 2/227 |
| 4,864,742 | 9/1989 | Grilliot et al. | 36/109 |
| 5,005,216 | 4/1991 | Blackburn et al. | 2/79 |
| 5,022,096 | 6/1991 | Pacanowsky | 2/227 |
| 5,058,208 | 10/1991 | Adams | 2/80 |
| 5,131,098 | 7/1992 | Grilliot et al. | 2/227 |
| 5,282,277 | 2/1994 | Onozawa . | |
| 5,611,082 | 3/1997 | Bull | 2/79 |
| 5,787,502 | 8/1998 | Middleton . | |

OTHER PUBLICATIONS

International Search Report in International Application No. PCT/US99/01666.

Morning Pride 1998 Catalog—see pp. 42, 43, 52, and 93.

Sketches, one sheet—undated.

*Primary Examiner*—John J. Calvert
*Assistant Examiner*—Robert H. Muromoto, Jr.
*Attorney, Agent, or Firm*—Robert, Milnamow & Katz, Ltd.

[57] ABSTRACT

For a firefighter, rescue worker, or chemical worker or for a person engaged in an outdoor activity, a protective garment wearable as an outer garment or as a lining system under an outer shell and with a pair of boots having leg-encasing portions, comprises a pair of pants including a pair of leg portions. Fitting into an associated one of the pair of boots when the garment and boots are worn together, each leg portion has an outer layer being a moisture barrier and terminating in an outer sock and has an inner layer being a thermal liner and terminating in an inner sock or in a stirrup. The garment further comprises a pair of cuffs, each cuff being attached to and around the outer layer of an associated one of the leg portions so extend downwardly, over and around an upper area on the leg-encasing portion of the associated one of the boots when the garment and boots are worn. The cuffs divert water or other liquids sprayed or splashed onto the leg portions, so as to prevent the diverted liquids from entering the leg-encasing portions of the boots.

26 Claims, 2 Drawing Sheets

PROTECTIVE GARMENT WITH LEG PORTIONS AND WITH CUFFS TO PREVENT LIQUIDS FROM ENTERING BOOTS

TECHNICAL FIELD OF THE INVENTION

This invention pertains to a protective garment that may be advantageously worn by a firefighter, rescue worker, or chemical worker, or by a person engaged in an outdoor activity. The protective garment, which is wearable as an outer garment or as a lining system under an outer shell, is wearable with a pair of boots, which in many instances may be uninsulated except by the garment. The protective garment has cuffs, which extend downwardly, over and around leg-encasing portions of the boots when the garment and boots are worn. The cuffs divert water or other liquids so as to prevent the diverted liquids from entering the leg-encasing portions of the boots.

BACKGROUND OF THE INVENTION

Commonly, a firefighter, rescue worker, or chemical worker wears a pair of boots having leg-encasing portions, a pair of socks, an outer, protective shell, which is made from a material providing resistance to abrasion and to puncturing, and an inner, protective, lining system, which is worn under the outer shell. Commonly, the outer shell and the lining system are integrated, as by being sewn together. The lining system has two leg portions, which are included in a pair of pants, a pair of overalls, or a suit of coveralls. Commonly, each leg portion has an outer layer made from a material providing a moisture barrier and an inner layer made from a material providing thermal protection. An outdoor worker or a person engaged in an outdoor activity, such as farming, hunting, fishing, or riding on a snowmobile, may wear similar garments over similar boots.

This invention has resulted from efforts to improve a protective garment, as mentioned above, whereby the improved garment is wearable with boots.

SUMMARY OF THE INVENTION

This invention provides improvements in a protective garment that may be advantageously worn by a firefighter, rescue worker, or chemical worker or by a person engaged in an outdoor activity, such as farming, hunting, fishing, or riding on a snowmobile. Being wearable as an outer garment or as a lining system under an outer shell and being wearable with a pair of boots having leg-encasing portions, the protective garment comprises a pair of leg portions, each fitting into an associated one of the boots, and a pair of cuffs, each being attached to an associated one of the leg portions so as to extend downwardly, over and around an upper area of the leg-encasing portion of the associated one of the boots when the garment and boots are worn. The cuffs divert water or other liquids sprayed or splashed onto the leg portions, so as to prevent the diverted liquids from entering the leg-encasing portions of the boots. Preferably, the leg portions are included in a pair of pants, a pair of overalls, or a suit of coveralls.

If each leg portion comprises an outer layer and an inner layer, such as an outer layer made from a material providing a moisture barrier and an inner layer made from a material providing a thermal liner, each cuff is attached to the outer layer of an associated one of the leg portions. In a preferred embodiment, in which the protective garment is a lining system worn under an outer shell, the outer layer of each leg portion terminates in an outer sock and the inner layer of each leg portion terminates in an inner sock. In an alternative embodiment, the outer layer of each leg portion terminates in an outer sock and the inner layer of each leg portion terminates in a stirrup.

This invention also combines a protective garment, in any of its embodiments described above, with a pair of boots, which may be uninsulated except for the protective garment.

These and other objects, features, and advantages of this invention are evident from the following description of a preferred embodiment of this invention and alternative embodiments thereof, with reference to the accompanying drawings.

DETAILED DESCRIPTION OF THE ILLUSTRATED EMBODIMENTS

Figure 1:
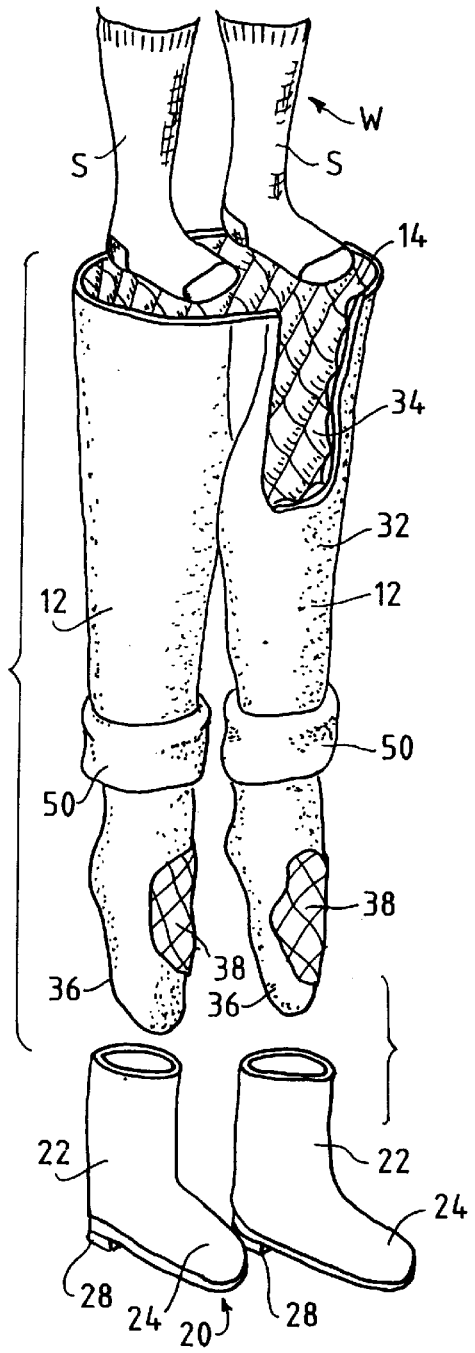
FIG. 1 is an exploded, fragmentary, perspective view of a protective garment constituting the preferred embodiment of this invention, as worn by a person who is wearing socks.
Figure 2:
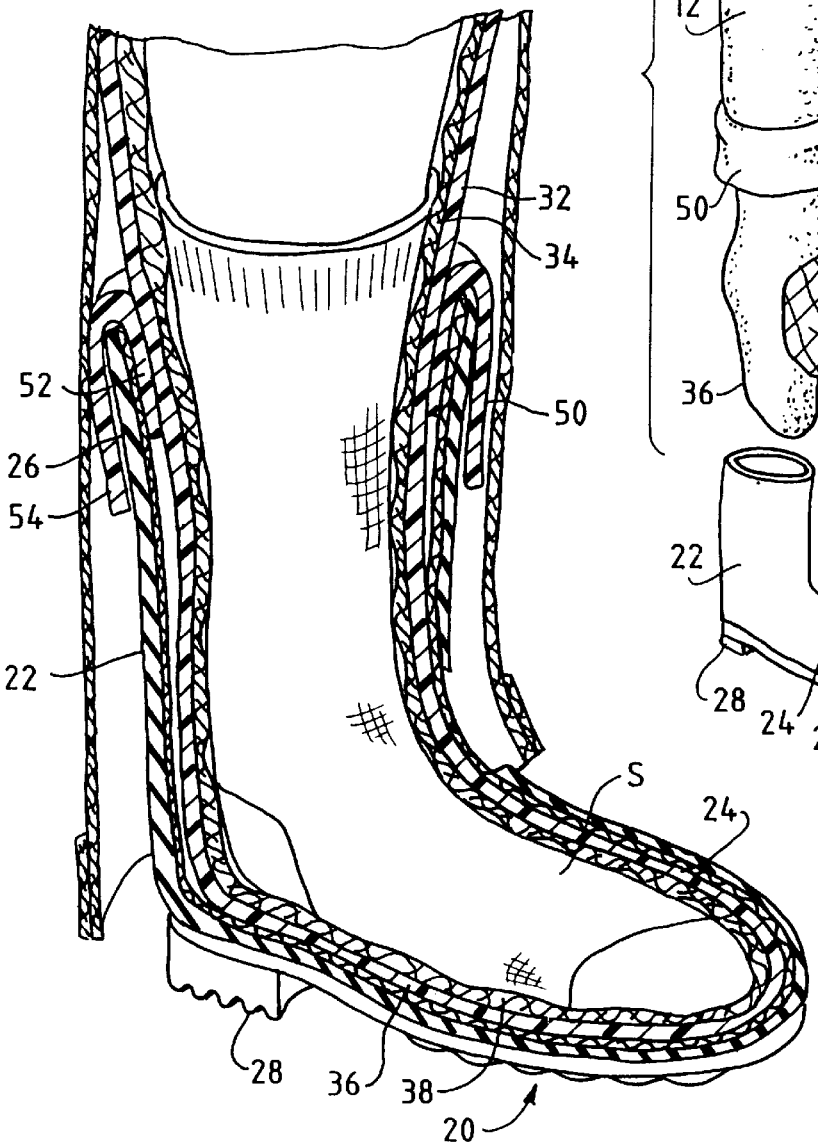
FIG. 2 is an enlarged, fragmentary, perspective, sectional view of one of two leg portions of the protective garment of FIG. 1, as worn with a boot, which is uninsulated except for the protective garment. One leg of an outer shell is shown fragmentarily.

As illustrated in FIG. 1, a protective garment 10 for a wearer W, such as a firefighter, rescue worker, or chemical worker, constitutes the preferred embodiment of this invention. The protective garment 10 may be also worn by a person engaged in an outdoor activity, such as hunting, fishing, or riding on a snowmobile. Preferably, the protective garment 10 is wearable as a lining system under an outer shell G (see FIG. 2) with which the protective garment 10 is integrated, as by sewing, and which is made from a material providing resistance to abrasion and to puncturing. Alternatively, the protective garment 10 is wearable as an outer garment. In either instance, the protective garment 10 is wearable over socks S made from a lightweight material. Details of the outer shell G and of the socks S are outside the scope of this invention.

Moreover, in either instance, the protective garment 10 is wearable with a pair of boots 20 to be respectively worn over the right and left feet of the wearer W. Each boot 20 has a leg-encasing portion 22 and a foot-encasing portion 24. Each boot 20 comprises a boot shell made from a conventional, rubberized fabric or from a natural or synthetic leather, which may be conventionally waterproofed, and each boot 20 comprises a conventional heel 28. Preferably, except in one instance mentioned below, each boot 20 is uninsulated except for the protective garment 10.

Preferably, whether worn as an outer garment or as a lining system under an outer shell, the protective garment 10 has an outer layer 12, which is made from a material providing a moisture barrier, and an inner layer 14, which is made from a material providing a thermal liner, and which is sewn to the outer layer 12 in a conventional manner so that the outer layer 12 and the inner layer 14 can be simultaneously put on and taken off by the wearer W. Suitable materials providing a moisture barrier and a thermal liner have been employed heretofore to make protective garments for firefighters, as available commercially from Morning Pride Manufacturing, L.L.C. of Dayton, Ohio.

The protective garment 10 comprises a pair of leg portions 30 to be respectively worn over the right and left legs of the wearer W. As shown, the protective garment 10 is embodied as a pair of pants. The protective garment 10 may be alternatively embodied as a pair of overalls or as a suit of coveralls.

The outer layer 12 defines an outer layer 32 of each leg portion 30. The inner layer 14 defines an inner layer 34 of each leg portion 30. The outer layer 32 of each leg portion 30 terminates in an outer sock 36. Preferably, the outer sock 36 is made from the material used to make the outer layer 32, namely the material providing the moisture barrier. Alternatively, the outer sock 36 is made from a thinner, lighter material. The inner layer 34 of each leg portion 30 terminates in an inner sock 38.

As contemplated by this invention, the protective garment 10 further comprises a pair of cuffs 50, which are made from the material used to make the outer layer 12, namely the material providing the moisture barrier. Each cuff 50 is attached by sewing, which is preferred, or by gluing to and around an associated one of the leg portions 30 so as to extend downwardly, over and around an upper area 26 on the leg-encasing portion 22 of the associated one of the boots 20. A seam-waterproofing material (not shown) of a type used conventionally in protective garments for firefighters may be advantageously employed where each cuff 50 is sewn thereto and therearound. Each cuff 50 has an inner portion 52, which is attached, and an outer portion 54, which is folded so as to extend downwardly. The cuffs 50 cuffs divert water or other liquids sprayed or splashed onto the leg portions 30, so as to prevent the diverted liquids from entering the leg-encasing portions 22 of the boots 20.

Figure 3:
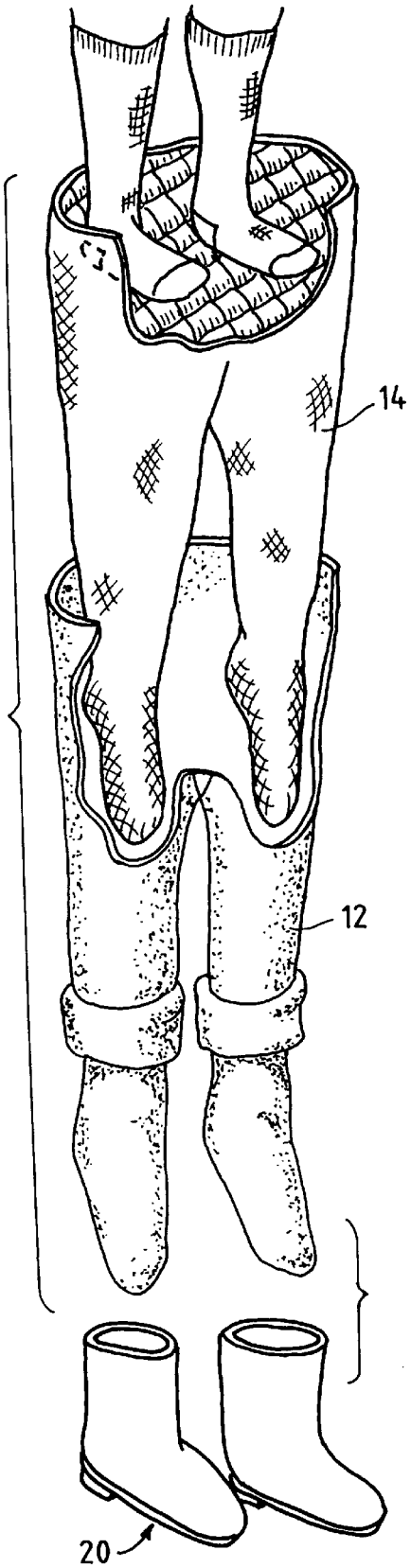
FIG. 3 is an exploded, fragmentary, perspective view of a protective garment constituting an alternative embodiment of this invention, as worn by a person who is wearing socks.
Figure 4:
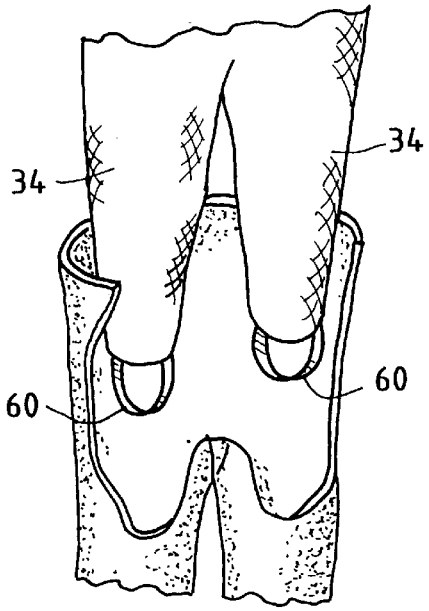
FIG. 4 is an exploded, fragmentary, perspective view of a protective garment constituting another alternative embodiment of this invention.

The alternative embodiment illustrated in FIG. 3 is similar to the preferred embodiment, except that the outer layer 12 and the inner layer 14 are separate, not attached directly to each other. The alternative embodiment illustrated in FIG. 4 is similar to the alternative embodiment illustrated in FIG. 3, except that the inner layer 34 of each leg portion 30 terminates in a stirrup 60, rather than in an inner sock 38. Another alternative embodiment is contemplated, but not shown, in which the leg portions 30 are separate, not attached directly to each other.

Because the cuffs 50 help to prevent water or other liquids from entering the leg-encasing portions 22 of the boots 20, the protective garment 10 may be advantageously worn by a firefighter, rescue worker, or chemical worker. There is no need for the boots 20 to be separately insulated with a moisture barrier.

In the embodiments illustrated in FIGS. 1 and 3, if the outer socks 36 are made from the material providing a moisture barrier, the protective garment 10 provides the wearer's feet with further protection against water or other liquids. Moreover, if the inner socks 38 are made from the material providing the thermal liner, the protective garment 10 protect the wearer's feet against heating or chilling, even if the boots 20 are not insulated separately with a thermal liner. However, in the embodiment shown in FIG. 4, it is preferable for the boots 20 to be thermally insulated.

Other modifications may be also made without departing from the scope and spirit of this invention.

What is claimed is:

1. For wear with a pair of boots having leg-encasing portions, a protective garment comprising a pair of leg portions, each leg portion having a lower end, each leg portion being adapted for fitting into the leg-encasing portion of an associated one of the boots when the garment and boots are worn together, the garment further comprising a pair of cuffs, each cuff being attached to and around an associated one of the leg portions, at a sufficient distance above the lower end of the associated one of the leg portions to enable said cuff to extend downwardly, over and around an upper area of the leg-encasing portion of the associated one of the boots when the garment and boots are worn together with the leg portions fitting into the leg-encasing portions of the boots, whereby the cuffs divert water or other liquids sprayed or splashed onto the leg portions, so as to prevent the diverted liquids from entering the leg-encasing portions of the boots.

2. The protective garment of claim 1 wherein the leg portions and cuffs are made from a material providing a moisture barrier.

3. The protective garment of claim 1 wherein each leg portion terminates in a sock.

4. The protective garment of claim 1 wherein the leg portions, cuffs, and socks are made from a material providing a moisture barrier.

5. For wear with a pair of boots having leg-encasing portions, a protective garment comprising a pair of leg portions, each leg portion having a lower end, each leg portion comprising an outer layer and being adapted for fitting into the leg-encasing portion of an associated one of the boots when the garment and boots are worn together, the garment further comprising a pair of cuffs, each cuff being attached to and around the outer layer of an associated one of the leg portions, at a sufficient distance above the lower end of the associated one of the leg portions to enable said cuff to extend downwardly, over and around an upper area of the leg-encasing portion of the associated one of the boots when the garment and boots are worn together with the leg portions fitting into the leg-encasing portions of the boots, whereby the cuffs divert water or other liquids sprayed or splashed onto the leg portions, so as to prevent the diverted liquids from entering the leg-encasing portions of the boots.

6. The protective garment of claim 5 wherein the outer layers and cuffs are made from a material providing a moisture barrier and wherein the inner layers are made from a material providing a thermal liner.

7. The protective garment of claim 5 wherein the outer layer of each leg portion terminates in a sock.

8. The protective garment of claim 7 wherein the outer layers, cuffs, and socks are made from a material providing a moisture barrier and wherein the inner layers are made from a material providing a thermal barrier.

9. The protective garment of claim 5 wherein the outer layer of each leg portion terminates in an outer sock and wherein the inner layer of each leg portion terminates in an inner sock.

10. The protective garment of claim 9 wherein the outer layers, cuffs, and outer socks are made from a material providing a moisture barrier and wherein the inner layers and inner socks are made from a material providing a thermal liner.

11. The protective garment of claim 9 wherein the outer layers, cuffs, and socks are made from a material providing a moisture barrier and wherein the inner layers are made from a material providing a thermal barrier.

12. The protective garment of claim 5 wherein the outer layer of each leg portion terminates in a sock and wherein the inner layer of each leg portion terminates in a stirrup.

13. The protective garment of claim 1 or 2 wherein the leg portions and cuffs are included in a pair of pants, a pair of overalls, or a suit of coveralls including the leg portions and cuffs.

14. The protective garment of claim 3 or 4 wherein the leg portions, cuffs, and socks are included in a pair of pants, a pair of overalls, or a suit of coveralls.

15. The protective garment of claim 5 or 6 being a pair of pants including a outer layer and a inner layer attached to the outer layer of the pants, wherein the outer layer of the pants includes the outer layers of the leg portions, and wherein the inner layer of the pants includes the inner layer of the leg portions.

16. The protective garment of claim 7 or 8 being a pair of pants including a outer layer and a inner layer attached to the outer layer of the pants, wherein the outer layer of the pants includes the outer layers of the leg portions and the socks, and wherein the inner layer of the pants includes the inner layer of the leg portions.

17. The protective garment of claim 9 or 10 being a pair of pants including a outer layer and a inner layer attached to the outer layer of the pants, wherein the outer layer of the pants includes the outer layers of the leg portions and the outer socks, and wherein the inner layer of the pants includes the inner layer of the leg portions and the inner socks.

18. The protective garment of claim 11 or 12 being a pair of pants including a outer layer and a inner layer attached to the outer layer of the pants, wherein the outer layer of the pants includes the outer layers of the leg portions and the socks, and wherein the inner layer of the pants includes the inner layer of the leg portions.

19. The protective garment of an one of claims 1 through 11 combined with a pair of boots having leg-encasing portions, which boots are uninsulated except by the protective garment.

20. The protective garment of claim 12 combined with a pair of thermally insulated boots.

21. The protective garment of claim 13 combined with a pair of boots having leg-encasing portions, which boots are uninsulated except by the protective garment.

22. The protective garment of claim 14 combined with a pair of boots having leg-encasing portions, which boots are uninsulated except by the protective garment.

23. The protective garment of claim 15 combined with a pair of boots having leg-encasing portions, which boots are uninsulated except by the protective garment.

24. The protective garment of claim 16 combined with a pair of boots having leg-encasing portions, which boots are uninsulated except by the protective garment.

25. The protective garment of claim 17 combined with a pair of boots having leg-encasing portions, which boots are uninsulated except by the protective garment.

26. The protective garment of claim 18 combined with a pair of boots having leg-encasing portions, which boots are uninsulated except by the protective garment.

* * * * *